US009850582B2

(12) United States Patent
De Giulio

(10) Patent No.: US 9,850,582 B2
(45) Date of Patent: Dec. 26, 2017

(54) SYSTEM, METHOD AND KIT REGARDING APPLICATION OF A METAL EDGE TO A SURFACE

(71) Applicant: De Giulio Designs, LLC, Wilmette, IL (US)

(72) Inventor: Michael De Giulio, Kenilworth, IL (US)

(73) Assignee: DE GIULIO DESIGNS, LLC, Wilmette, IL (US)

( * ) Notice: Subject to any disclaimer, the term of this patent is extended or adjusted under 35 U.S.C. 154(b) by 0 days.

(21) Appl. No.: 14/668,401

(22) Filed: Mar. 25, 2015

(65) Prior Publication Data

US 2015/0272319 A1 Oct. 1, 2015

Related U.S. Application Data

(60) Provisional application No. 61/972,017, filed on Mar. 28, 2014.

(51) Int. Cl.
*A47B 96/20* (2006.01)
*C23F 1/02* (2006.01)

(52) U.S. Cl.
CPC ..... *C23F 1/02* (2013.01); *A47B 96/201* (2013.01); *Y10T 29/49826* (2015.01); *Y10T 428/24777* (2015.01)

(58) Field of Classification Search
None
See application file for complete search history.

(56) References Cited

U.S. PATENT DOCUMENTS

| | | | | |
|---|---|---|---|---|
| 2,032,878 | A | 3/1936 | Hunter | |
| 5,491,115 | A * | 2/1996 | Pfitzenmaier | C03C 10/0027 501/4 |
| 6,026,610 | A | 2/2000 | Northrop et al. | |
| 2005/0268440 | A1* | 12/2005 | Bovard | A61G 17/04 27/2 |
| 2006/0102729 | A1* | 5/2006 | Gandel | G06K 19/02 235/487 |
| 2006/0172114 | A1* | 8/2006 | Hancock | A47B 13/08 428/119 |
| 2011/0108556 | A1* | 5/2011 | Levie | A21B 3/135 220/573.1 |

FOREIGN PATENT DOCUMENTS

| | | | |
|---|---|---|---|
| CN | 201100075 | Y | 8/2008 |
| WO | WO 2006/104291 | A1 | 10/2006 |

OTHER PUBLICATIONS

Wausau Awards and Engraving, Desk & Door Name Plates (via Internet Wayback Machine Apr. 19, 2013; hereafter referred to as "Wausau"); 14 pages.*

(Continued)

*Primary Examiner* — Laura Powers
(74) *Attorney, Agent, or Firm* — Brinks Gilson & Lione

(57) ABSTRACT

A surface that includes a three-dimensional surface, wherein a notch is present in said three-dimensional surface. The surface further includes a metal edge inserted into the notch and attached to the three-dimensional surface.

24 Claims, 13 Drawing Sheets

(56) References Cited

OTHER PUBLICATIONS

Flush/Reveal Wall Panel, https://www.pac-clad.com/wall-panels/flush-wall/ via Internet Wayback Machine, Dec. 1, 2013 http://web.archive.org/web/20131201115936/http://www.pac-clad.com/wall-panels/flush-wall/, 9 pages.*

International Search Report and Written Opinion issued in International Application No. PCT/US2015/22469 dated Jun. 17, 2015, 7 pages.

International Preliminary Report on Patentability for Patent Cooperation Treaty patent application PCT/US2015/022469, dated Oct. 13, 2016, 6 pages.

* cited by examiner

SYSTEM, METHOD AND KIT REGARDING APPLICATION OF A METAL EDGE TO A SURFACE

This application claims the benefit of priority under 35 U.S.C. §119(e)(1) of U.S. Provisional Application Ser. No. 61/972,017, filed Mar. 28, 2014, the entire contents of which is incorporated herein by reference.

BACKGROUND

1. Technical Field

The present invention relates to a system, method and kit regarding application of a metal edge to a surface.

2. Background Information

Furniture with surfaces and/or work surfaces, such as countertops and panels, traditionally lack any identification as to its manufacturer when used by a customer. This can lead to confusion for the customer as to the identification of the manufacturer of the furniture. Such identification could be useful if the customer want to contact the manufacture regarding the surface and/or work surface or wishes to purchase a surface and/or work surface from the manufacturer.

In addition, if delicate edge details were to be added to the above mentioned surfaces and/or work surfaces, it would typically result in high stone fabrication costs.

BRIEF SUMMARY OF THE INVENTION

One aspect of the present invention regards a surface that includes a three-dimensional surface, wherein a notch is present in said three-dimensional surface. The surface further includes a metal edge inserted into the notch and attached to the three-dimensional surface.

A second aspect of the present invention regards a method of manufacturing a surface that includes forming a notch within a three-dimensional surface and inserting a metal edge within the notch. The method further includes attaching the inserted metal edge to the three-dimensional surface.

One or more aspects of the present invention provide the advantage of identifying the manufacturer of a surface, such as a work surface or a panel, One or more aspects of the present invention provide the advantage of allowing for the creation of delicate edge details without costly fabrication costs.

The accompanying drawings, which are incorporated herein and constitute part of this specification, and, together with the general description given above and the detailed description given below, serve to explain features of the present invention. Note that the drawings are all depictions of some of the concepts and profiles of the hardware and cross sections of the notched countertop edges with metal profiles applied.

DETAILED DESCRIPTION OF THE PREFERRED EMBODIMENTS

In general, the present invention regards a surface that is machined so as to receive a metal edge so that when viewed as a whole defines a new surface, such as a panel or a work surface, such as a countertop. The machined surface can be decorative in appearance with the inclusion of the metal edge, and the metal edge can be functional in that it can be used to have work performed thereon and it can be used to identify, brand and market the surface and its associated furniture by providing unique manufacturer logos and recognizable edge profiles.

Figures 1, 1A, 1B:
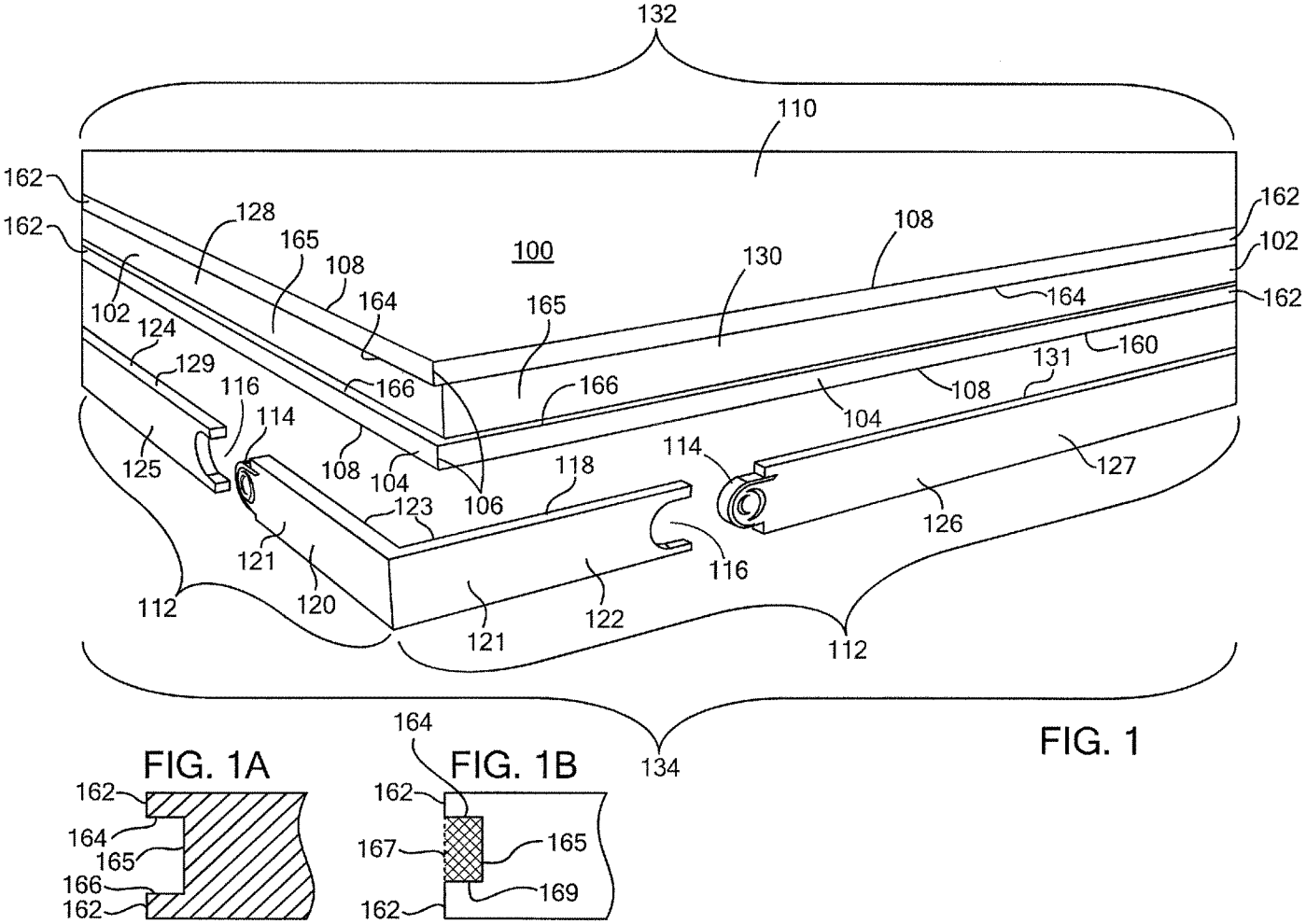
FIG. 1 shows a perspective and exploded view of a first embodiment of a work surface in accordance with the present invention.
FIG. 1A shows a side cross-sectional view of a notch formed in the surface of FIG. 1.
FIG. 1B shows the side cross-sectional view of FIG. 1A, wherein a cross-sectional area of a volume defined by the notch of FIGS. 1 and 1A is shown by cross hatches.

An embodiment of a work surface is shown in FIG. 1 is exemplary of basic principles regarding the other embodiments of FIGS. 2B and 6-19 and so will be described herein. In particular, a surface 100 defines a right parallelepiped. As shown in FIG. 1, the surface 100 includes a horizontal top surface 110, a bottom horizontal surface 160, and four vertical side surfaces 162, wherein the surfaces 110, 160 and 162 are integral with one another. Of course, other three dimensional shapes to define the surface are possible. The length, width, thickness of the surface 100 can be any value depending on the intended use of the surface 100. The surface 100 can be made of any material. An example of a suitable material is quartz, such as the quartz manufactured by Caesarstone.

The surface 100 is worked with a tool to form a notch 102 in its sides. FIG. 1 shows notches 102 formed in two of the vertical sides 162 of surface 100. In particular, the notch 102 can be formed manually by using one or more tools, such as a router or a shaper with a specific router or shaping bit, which can be presented in a tool kit (not shown). The tool kit can also include pieces of a metal edge and a metal cutting tool to cut the pieces to a desired length. The tool kit can include surfacing samples with notching.

The notch 102 can be polygonal in cross-section and is preferably rectangular in cross-section as shown in FIG. 1. In the embodiment of FIG. 1, the notch 102 extends around the side walls 104 of the surface. As shown in FIGS. 1 and 1A-B, the notch 102 includes a horizontal top surface 164 and a horizontal bottom surface 166 that faces surface 164. A vertical side surface 165 of the notch 102 is integrally joined with the surfaces 164 and 166. As shown in FIGS. 1 and 1B, the notch 102 defines a volume (see cross-hatched cross-sectional area of volume shown in FIG. 1B) of space defined by the surfaces 164 and 165, wherein the volume does not extend past the vertical sides 162 as denoted by the vertical dashed lines 167 of FIG. 1B. The volume extends along the entire length of surface 165 along a direction that is perpendicular to the plane containing FIG. 1B. Note that FIGS. 1A-B are illustrative of notch 102 and are not intended to denote any particular dimensions for the notch 102. As shown in FIG. 1, the length of the notch 102 is substantially greater than either the height or depth of the notch 102. Note that the notch can be formed in other areas of the surface 100 as shown in FIGS. 8-10 and 12-14. For example, a notch can be formed at one of the corners 106, one of the edges 108 and the top surface 110. Furthermore, there could be multiple disconnected notches formed at different areas of the surface depending on the desired work surface to be produced.

Within the notch 102, a metal edge 112 is inserted. As shown in FIG. 1, the metal edge 112 can be made of multiple metal pieces that are interconnected to one another by a male connector 114 and a female connector 116. In particular, the female connector 116 is a U-shaped slot that receives a complementary male connector 114 so as to define a male/female connection. As is apparent from FIG. 1, the male/female connection is similar to an interconnection between two jigsaw pieces that engage one another.

As shown in FIG. 1, a pre-assembled corner piece 118 is inserted into a portion of a corner of the notch 102. The corner piece 118 has two sides 120, 122 that are integrally formed with one another, wherein side 120 has a male connector 114 and side 122 has a female connector 116. The corner piece 118 has a front, planar surface 121 that faces in a direction opposite to that faced by corresponding portions of rear surface 123. The sides 120 and 122 are equal in length and form a right angle. Of course, other shapes and dimensions for the corner piece 118 are possible, such as having unequal lengths for the sides and the sides form an angle other than 90 degrees.

As shown in FIG. 1, straight pieces 124 and 126 are inserted into central sections 128 and 130, respectively, of the notch 102. The straight pieces 124, 126 have front, planar surfaces 125, 127 that face in a direction opposite to that faced by corresponding rear surfaces 129, 131. The male connector 114 of corner piece 118 engages a female connector 116 of the straight piece 124 and the female connector 116 of corner piece 118 engages a male connector 114 of the other straight piece 126. Note that when the above described male/female connection/engagement is made, the pieces 118, 122 associated with the female connectors 116 extend lengthwise along the same direction that the corresponding pieces 118, 126 associated with the male connectors 114 extend lengthwise. In addition, when the assembled metal edge 112 is positioned within the notch 102, a front, planar surface (121, 125, 127) of the metal edge 112 is parallel to and faces away the surface 165 of the notch 102. Furthermore, when the assembled metal edge 112 is positioned within the notch 102, a rear surface (123, 129, 131) of the metal edge 112 1) faces the surface 165 of the notch 102, 2) covers the surface 165 in its entirety, and 3) is positioned between the front surface of the metal edge 112 and the surface 165 of the notch 102

Not shown in FIG. 1 is that the straight pieces 124 and 126 will engage with the male connectors 114 and female connectors 116 of corner pieces 118 at two other corners of the notch 102. In addition, a second set of straight pieces 124 and 126 are placed in central sections of the notch 102 that are positioned opposite to the central sections 128 and 130, respectively. The second set of straight pieces 124 and 126 are connected with the previously mentioned corner pieces and a fourth corner piece placed in the remaining corner portion of the notch 102. The various straight pieces 124, 126 and corner pieces 118 are attached within the notch 102 by using an adhesive between the surface of the notch 102 and a rear side of each of the straight and corner pieces. Of course, other attachment structures between the surface 100 and the metal pieces 118, 124, and 126. For example, mechanical devices, such as pins, could be used alone or in combination with the adhesive to attach the metal pieces 118, 124, 126 to the surface 100. When all the above mentioned straight pieces 124, 126 and corner pieces 118 are attached to one another and positioned with the notch 102, a work surface 132 is formed that includes the notched surface 100 and a rectangular metal edge 134.

Figure 2A:
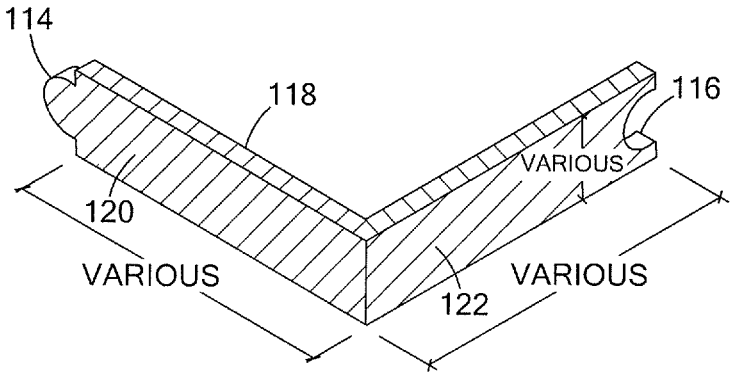
FIG. 2A shows an embodiment of an outer corner piece to be used with the work surface of FIG. 1 in accordance with the present invention.
Figure 2B:
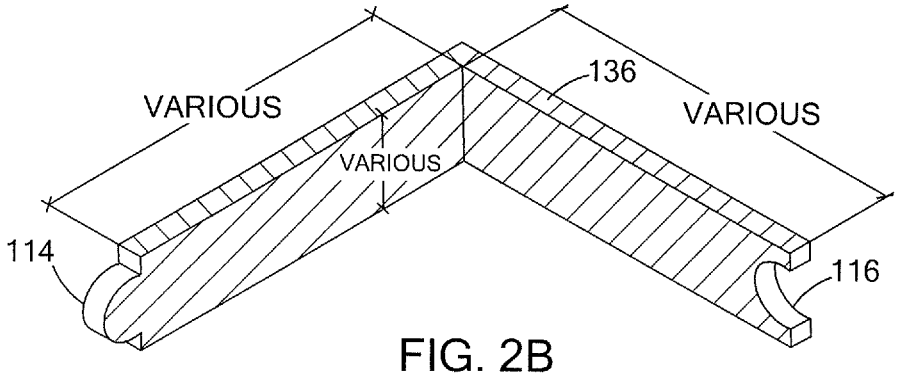
FIG. 2B shows an embodiment of an inner corner piece in accordance with the present invention.
Figure 3:
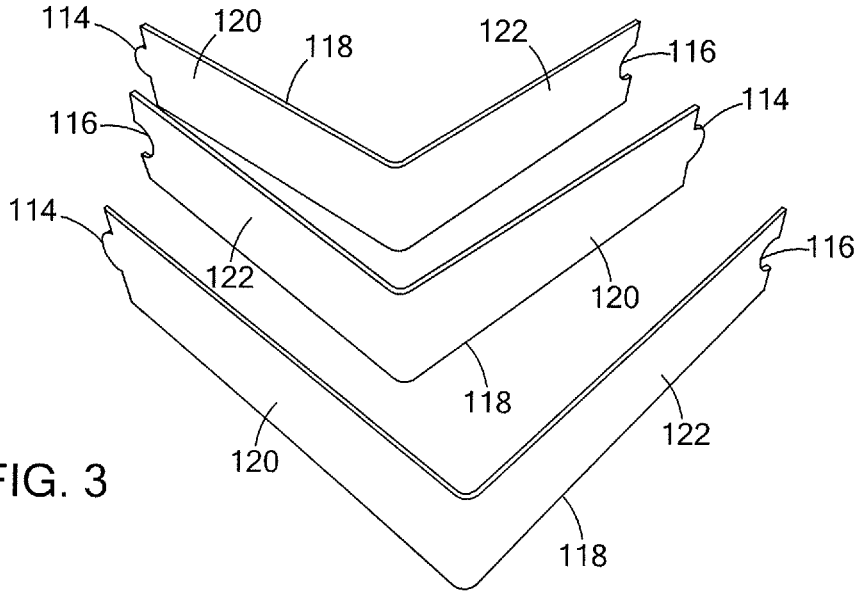
FIG. 3 shows an embodiment of an outer corner piece to be used with the work surface of FIG. 1 in accordance with the present invention.
Figure 4:
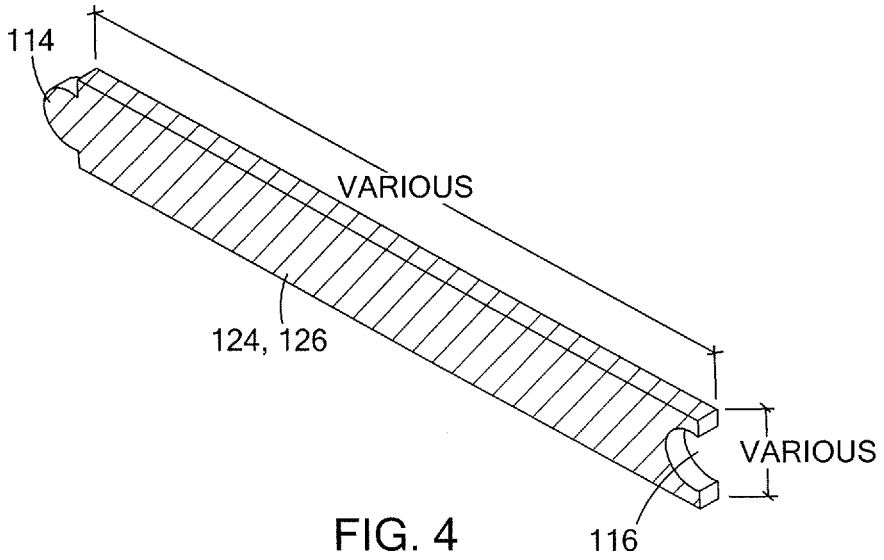
FIG. 4 shows an embodiment of a straight piece to be used with the work surface of FIG. 1 in accordance with the present invention.
Figure 5A:
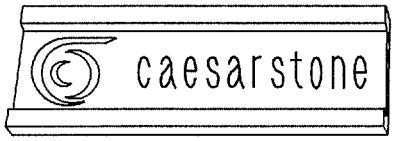
FIGS. 5A-G show possible engravements to be used with the work surface of FIG. 1 and the corner and straight pieces of FIGS. 2A-B, 3 and 4.
Figure 5C:
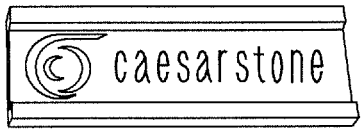
Figure 5B:
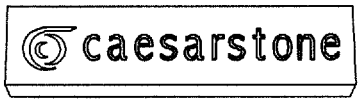
Figure 5D:
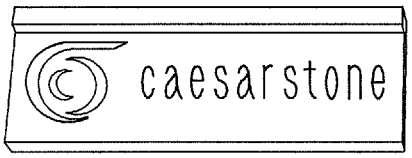
Figure 5F:
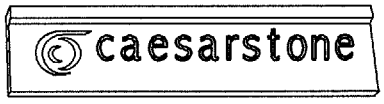
Figure 5E:
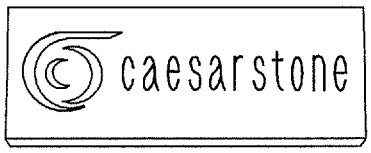
Figure 5G:
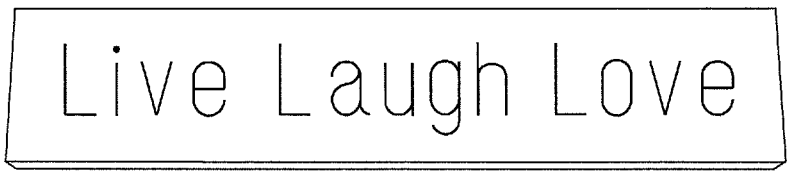

The work surface 132 of FIG. 1 is but an example of a possible result of the use of the metallic pieces and sections mentioned previously. It is envisioned that the straight pieces 124 and 126 and the corner pieces 118 are prefabricated by being cut to a size based on a particular work surface or panel to be formed and into various decorative/function profiles and sizes. For example, the length, height, and width of the corner piece 118 can be varied based on the workpiece to be formed as illustrated in FIGS. 2A and 3. Thus, depending on the width chosen, the corner piece 118 can be entirely contained within the volume (see cross hatch of FIG. 1B) defined by notch 102, flush with the vertical side 162 of surface 100, or extend past side 162. Similarly, the length, height, and width of the straight pieces 124 and 126 can be varied as illustrated in FIG. 4. Thus, depending on the width chosen, the straight pieces 124 and 126 can be entirely contained within the volume defined by notch 102, flush with the vertical side 162 of surface 100, or extend past side 162. In addition, besides an outside corner piece 118, a prefabricated inside corner piece 136 of various lengths, heights, and widths can be manufactured as shown in FIG. 2B so as to provide edging for work surfaces that have an inside corner. Note that under certain circumstances, the outside corner piece 118 can be flipped to provide an inside corner piece 136.

Many types of finishes for the metal pieces are possible, such as stainless steel, brushed stainless steel, polished stainless steel, bronze, carbon, braided metals and copper patina. The use of pre-fabricated corner pieces 118 and 136 eliminate the need for miter cutting and joint fitting at corners, which is often a problem with fabricators who are not used to working with metals. Note that in certain circumstances, the metal edge can be a single piece. In addition, the thickness of the metal edge can be constant throughout or variable.

As can be readily understood by the previous description, the work surface 132 of FIGS. 1, 2A, 3 and 4 provides many advantages. For example, it demonstrates a modular system that can be applied to any building material and is easily stocked, shipped and assembled. The metal edge functions as a joining element, wherein seams become details, materials can be mixed and waste is reduced. Use of the metal edge will result in a reduction in service calls to repair chipped edges since the metal edge provides edge protection at corners and sinks. The use of the metal edge also provides opportunities for providing decorative designs thereon. Also, the metal edge provides the opportunity to laser etch/engrave text on an exterior facing side of either of the sections 118, 124 and 126, which can be used to brand the work surface 132 with a logo, the name of the manufacturer or other identifying symbol, such as a trademark. Examples of such engraved text are shown in FIGS. 5 A-G.

Figure 6:
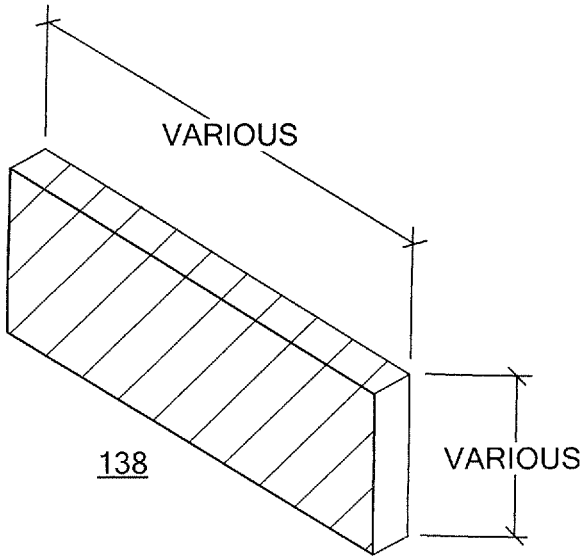
FIG. 6 shows a perspective view of an embodiment of a tab in accordance with the present invention.

Based on the above principles, various work surfaces can be formed. For example, suppose at one of the sides of the notch 102 of FIG. 1 the straight section 124 does not have a sufficient length to be connected to the corner pieces 118. In this case, the straight section 124 is cut with the metal cutting tool of the previously mentioned tool kit so as to form two pieces of the same length. The two pieces are inserted and attached with the notch 102 and attached to the corner pieces 118 as describe previously. This will result in a gap forming between the two pieces. The gap is hidden by inserting a tab 138, as shown in FIG. 6, into the gap. The tab 138 can have various lengths, heights and widths depending on the work surface being formed. The tab 138 is attached within the notch 102 using either an adhesive or other attachment structures as previously discussed with respect to the attachment of metal pieces 118, 124, and 126. The tab 138 can also include etching/engraving as previously described with respect to the metal pieces 118, 124 and 126.

As another example, suppose at one of the sides of the notch 102 of FIG. 1 the straight section 124 is too long to be connected to the corner pieces 118. In this case, the straight section 124 is cut by the metal cutting tool of the previously mentioned tool kit so that a middle portion is removed and the two remaining pieces are of the same length. The combined length of the two remaining pieces is such that when the pieces are connected to the corner pieces 118 no gap is formed between the straight pieces. The two pieces are inserted and attached with the notch 102 and attached to the corner pieces 118 as describe previously.

Figure 7:
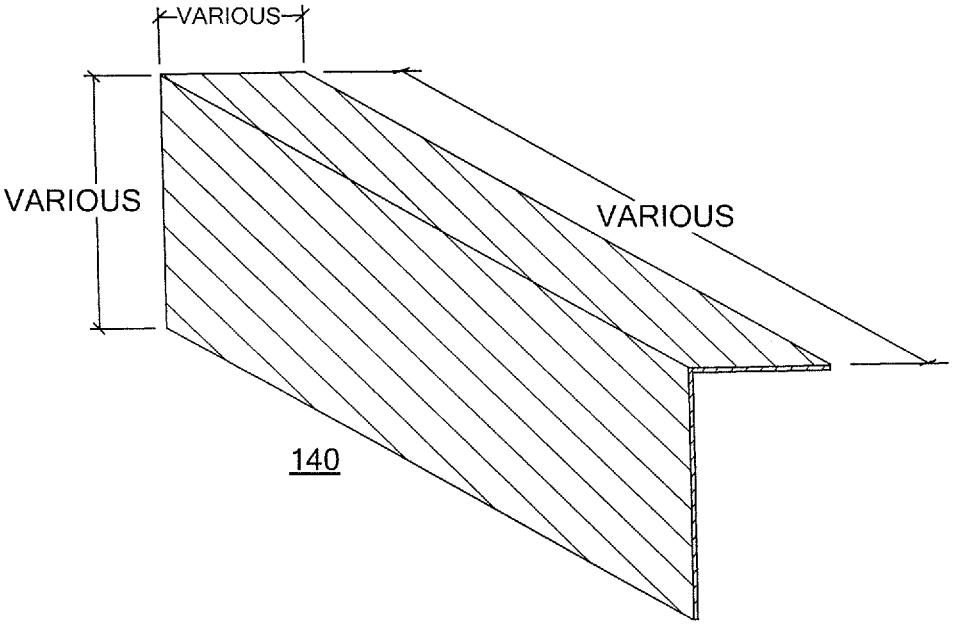
FIG. 7 shows a perspective view of an embodiment of a handle in accordance with the present invention.
Figure 8:
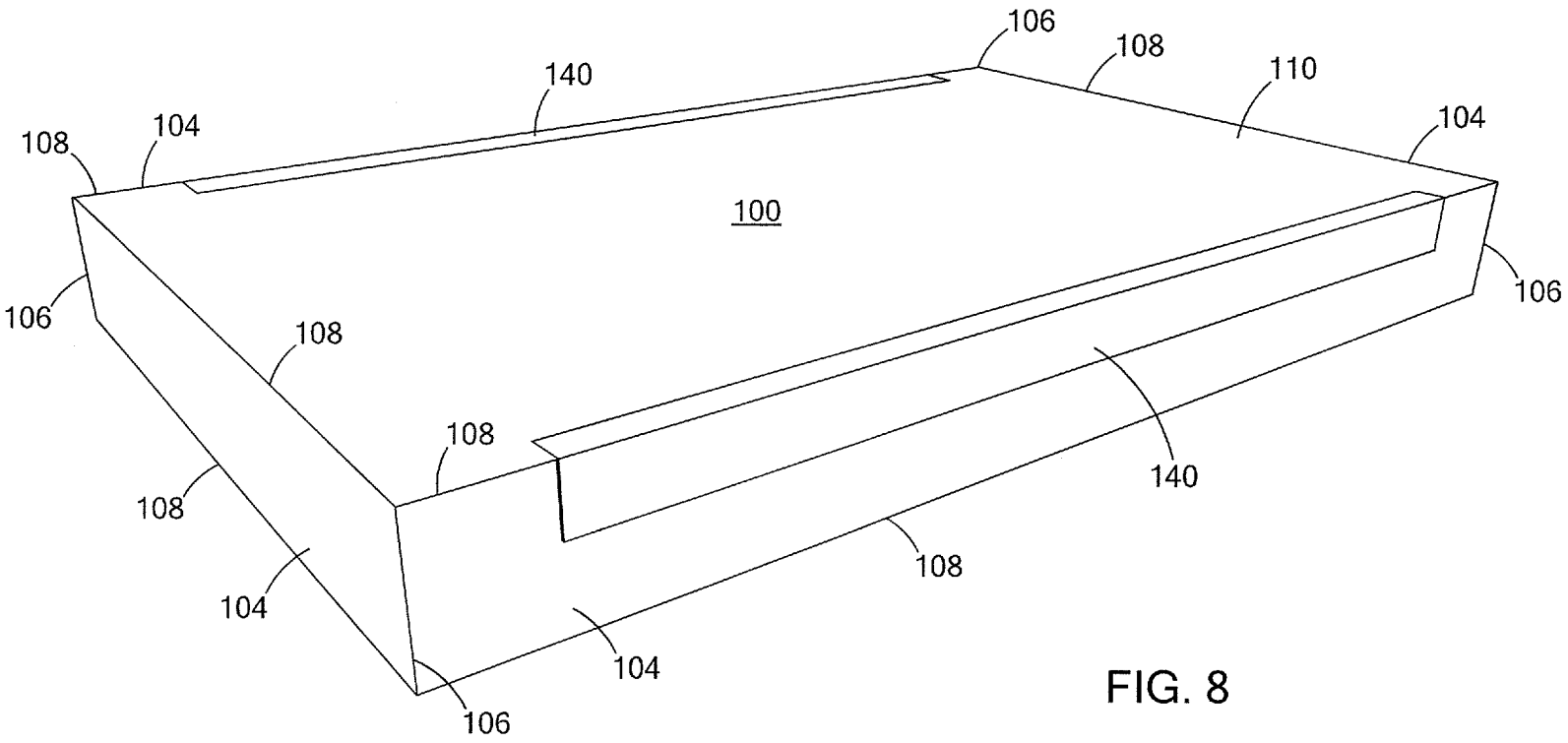
FIG. 8 shows a perspective view of a first embodiment of work surface that uses the handle of FIG. 7 in accordance with the present invention.
Figure 9:
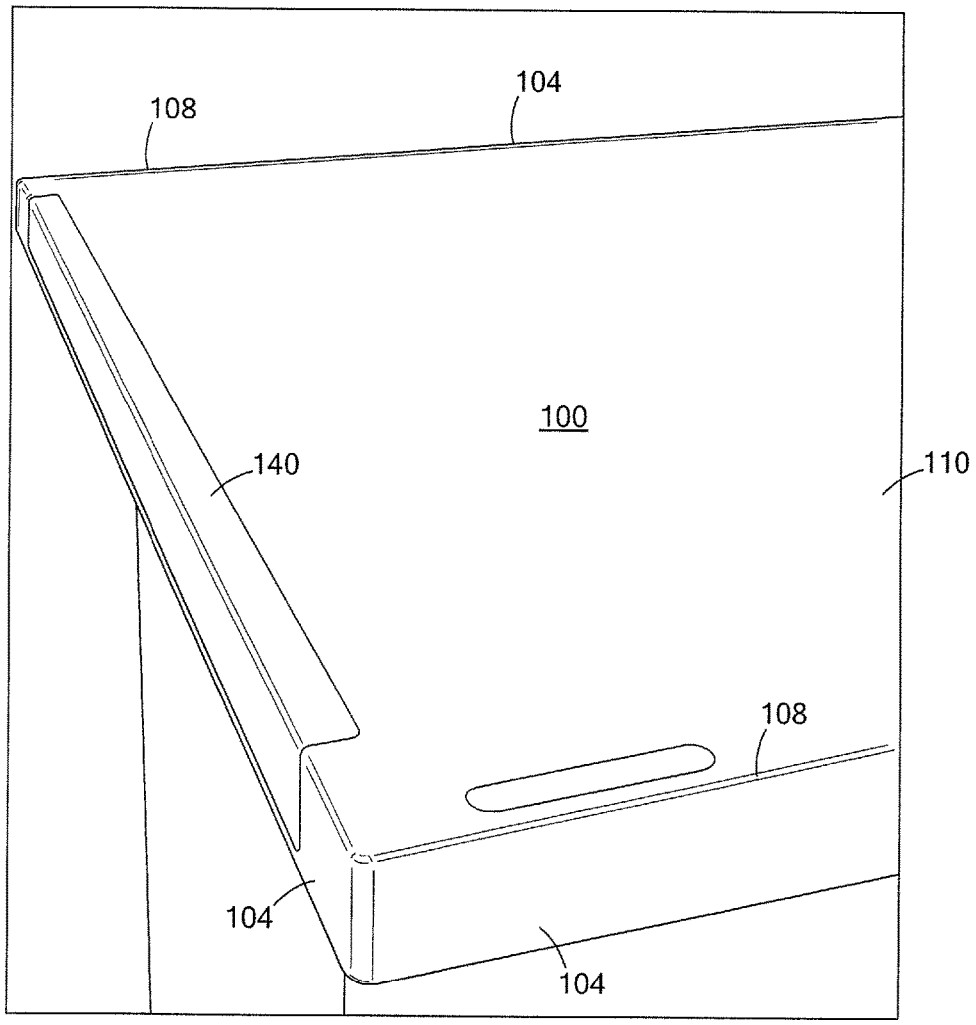
FIG. 9 shows a perspective view of a second embodiment of work surface that uses the handle of FIG. 7 in accordance with the present invention.
Figure 10:
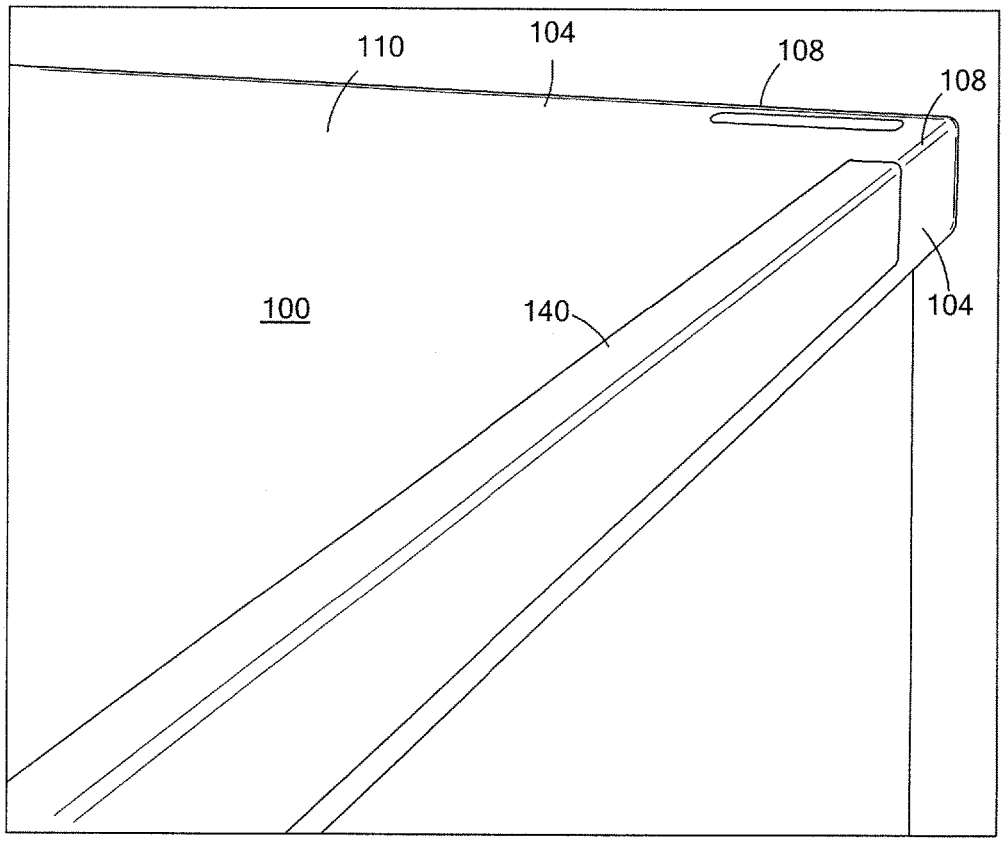
FIG. 10 shows an enlarged perspective view of the work surface and handle of FIG. 9.

The previously described edgings regard an edging that surrounds a portion of the surface 100 and is below the top surface 110 of the surface 100. The edgings can be formed solely on the top surface 110 or both the top surface 110 and one or more side surfaces 104 of the surface 100. In the latter case, a handle 140 can be inserted into an L-shaped notch formed in the top surface 110 and a side surface 104 of the surface 100. The notch is manufactured using the tools of the tool kit mentioned previously. An example of a handle 140 to be inserted into the notch is shown in FIG. 7. The length, thickness and the size of the L-shaped cross-section of the handle 140 can be varied depending on the type of work surface to be formed. The handle 140 is attached within the notch using an adhesive or other attachment structures as previously discussed with respect to the attachment of metal pieces 118, 124, and 126. Examples of handles 140 are shown in FIGS. 8-10. Note that the handle 140 can include etching/engraving as previously described with respect to the metal pieces 118, 124 and 126.

Figure 11:
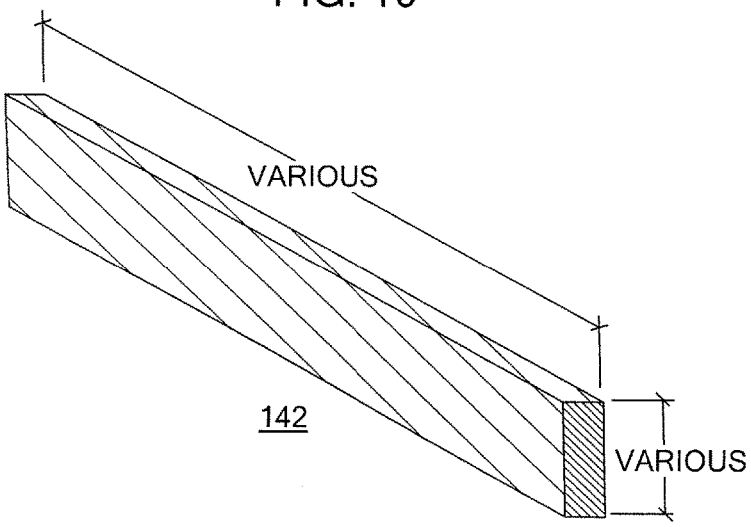
FIG. 11 shows a perspective view of an embodiment of a piping element in accordance with the present invention.
Figure 12:
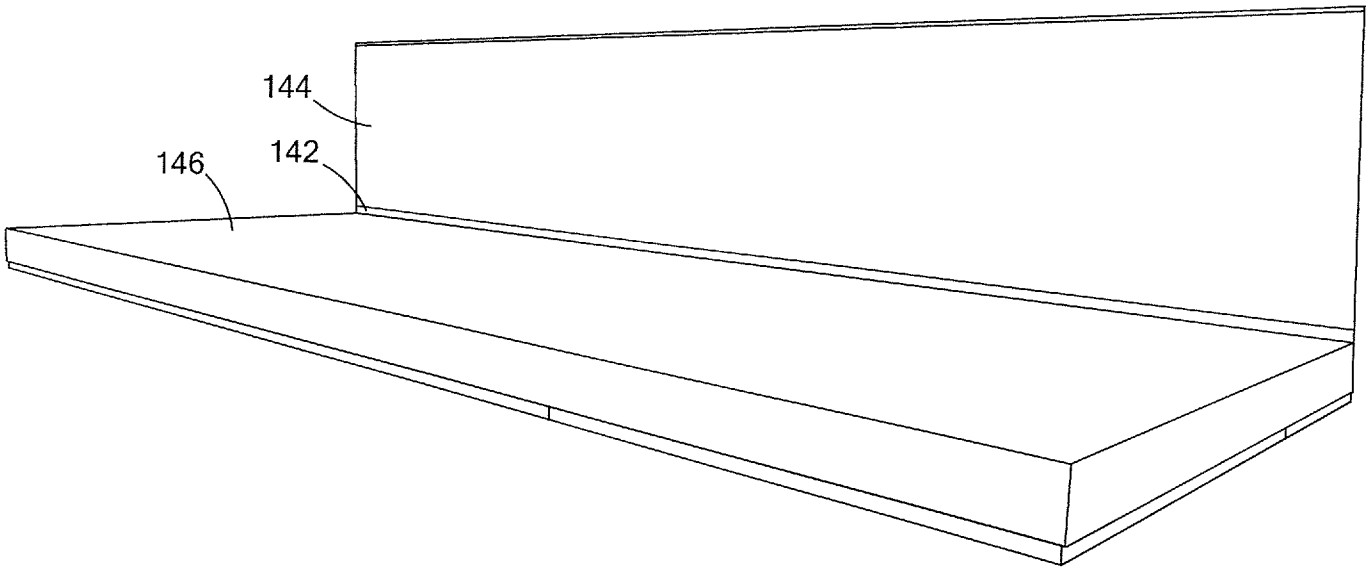
FIG. 12 shows a perspective view of an embodiment of backsplash that uses the piping element of FIG. 11 in accordance with the present invention.

Besides the metal edge 134 of FIGS. 1-6 and the handle 140 of FIGS. 7-10, the present invention can be used to form various types of piping elements. An example of a piping element 142 is shown in FIG. 11. The piping element 142 is in the form of a parallelepiped, wherein the length, width and height can have various values based on its intended use. One use for the piping element 142 is as a transition between two surfaces of a counter piece. As shown in FIG. 12, a rectangular groove is formed along the bottom length of a backsplash 144 that is adjacent to a counter surface 146. The notch is manufactured using the tools of the tool kit mentioned previously. The piping element 142 is attached within the notch using an adhesive or other attachment structures as previously discussed with respect to the attachment of metal pieces 118, 124, and 126.

Figure 13:
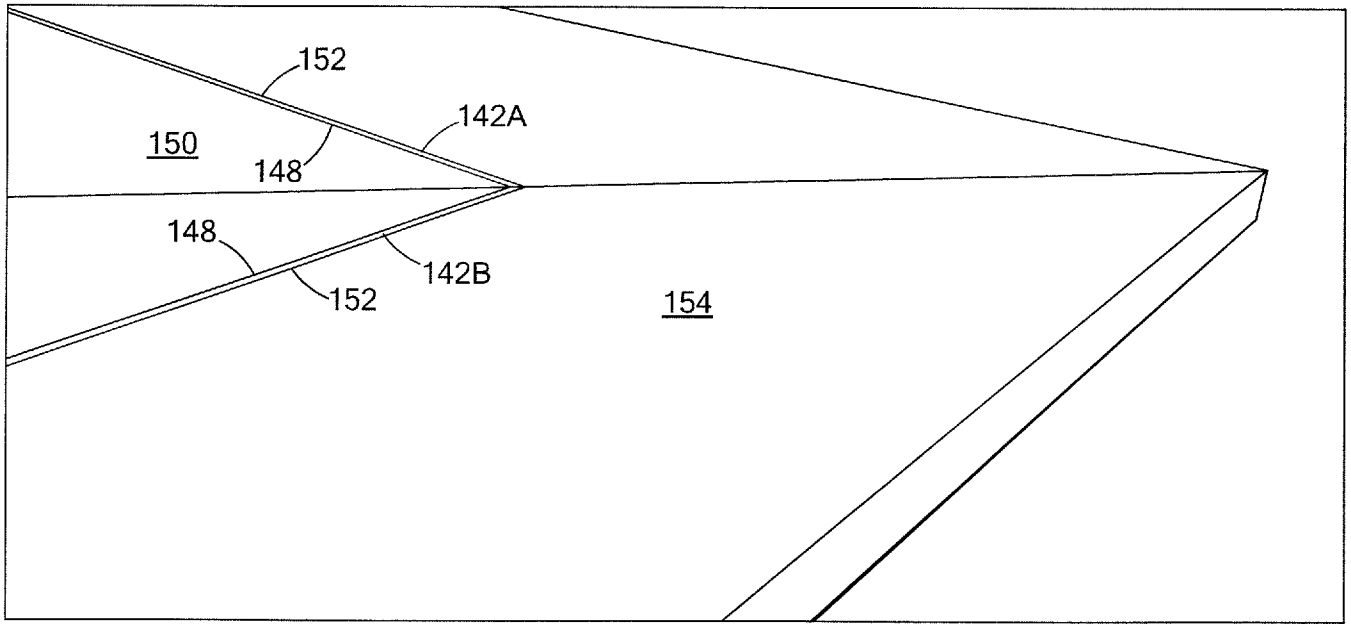
FIG. 13 shows a perspective view of a first embodiment of a work surface that uses the piping element of FIG. 11 in accordance with the present invention.
Figure 14:
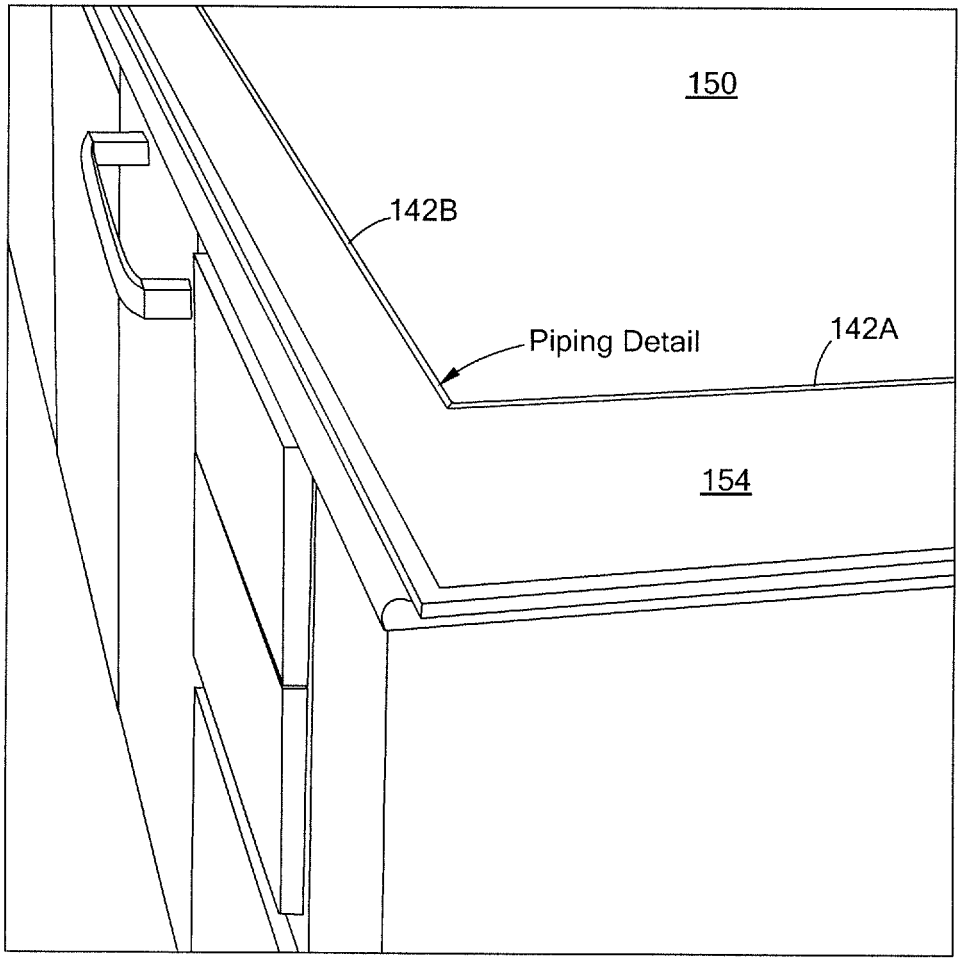
FIG. 14 shows a perspective view of a second embodiment of a work surface that uses the piping element of FIG. 11 in accordance with the present invention.

The piping element 142 can be used as a bead detail. As shown in FIG. 13, a rectangular groove is formed between an exterior edge 148 of an inner top surface 150 and an interior edges 152 of an outer top surface 154. A first piping element 142A is attached within a portion of the notch using an adhesive or other attachment structures as previously discussed with respect to the attachment of metal pieces 118, 124, and 126. An end of the first piping element 142A abuts against the interior edge 152 of the outer top surface 154. A second piping element 142B is attached within the remaining portion of the notch using an adhesive or other attachment structures as previously discussed with respect to the attachment of metal pieces 118, 124, and 126. An end of the second piping element 142B abuts against a side of the end of the first piping element 142A. A similar example of such a use of plural piping elements is shown in FIG. 14.

Figure 15:
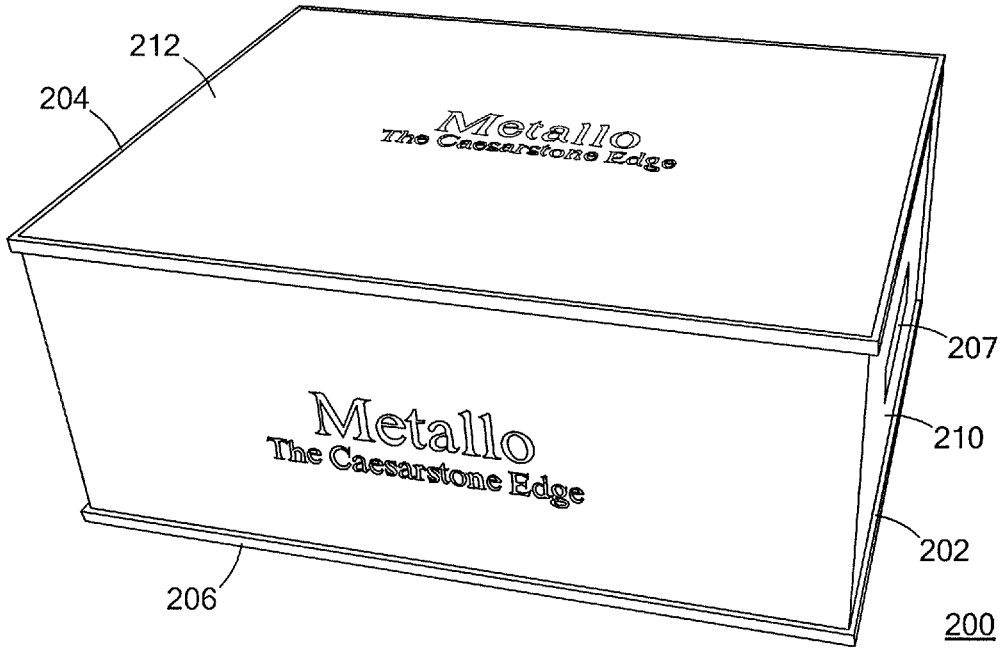
FIG. 15 shows a perspective view of an embodiment of a sales/presentation kit when an associated presentation box is in a closed position in accordance with the present invention, wherein the sales/presentation kit is to be used for one or more of the work surfaces and metal edges of FIGS. 1-14.
Figure 16:
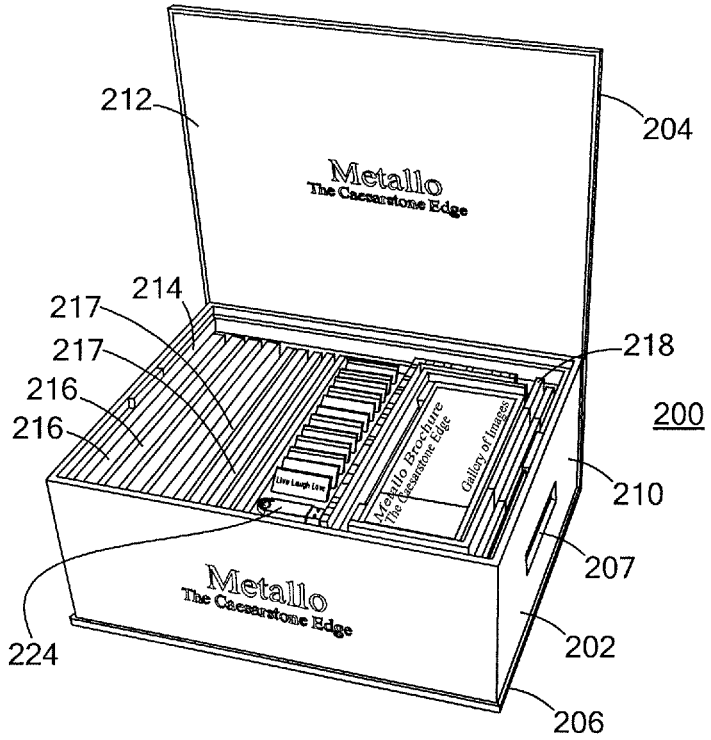
FIG. 16 shows the sales/presentation kit of FIG. 15 when the associated presentation box is in an opened position.
Figure 17:
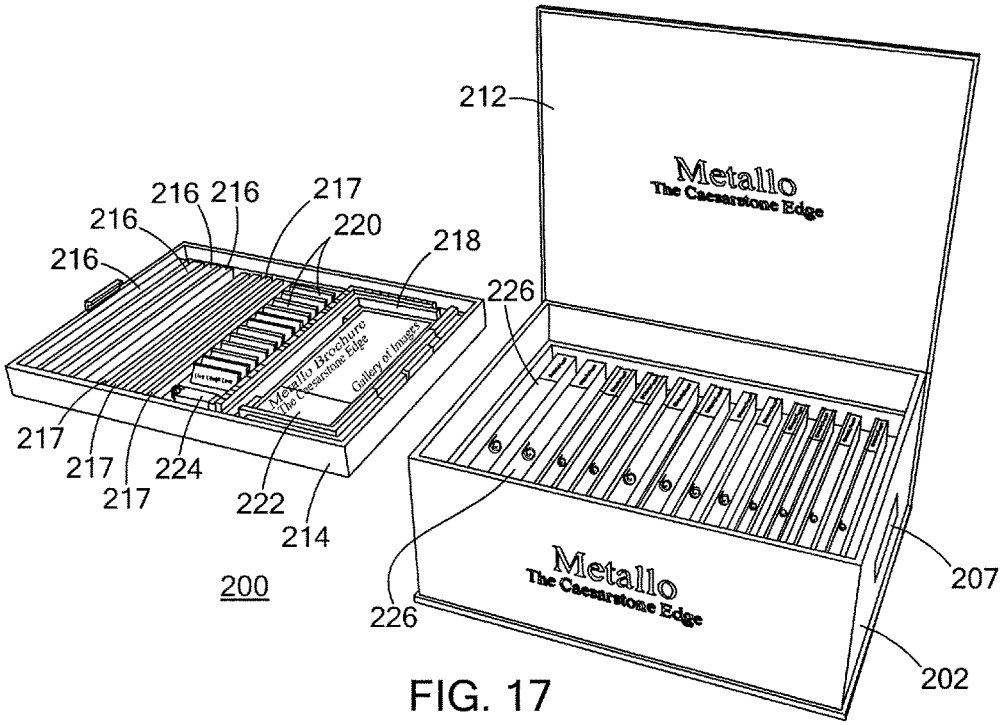
FIG. 17 shows the sales/presentation kit of FIG. 15 when the associated presentation box is in an opened position and when the top tray has been removed.
Figure 18:
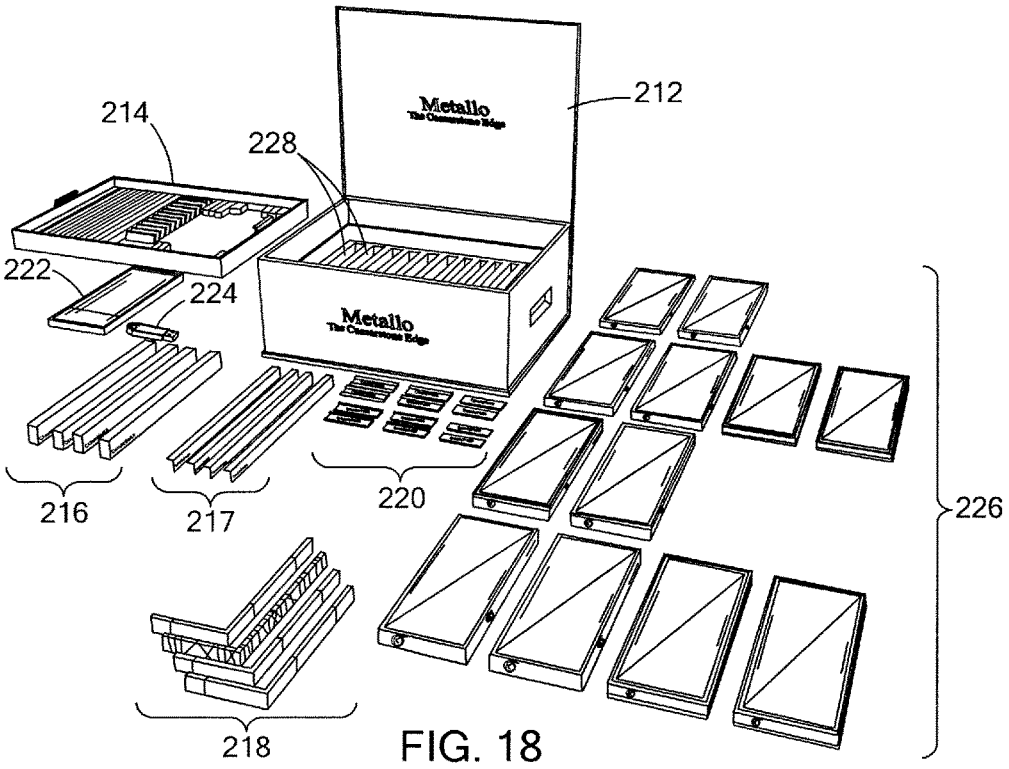
FIG. 18 shows the sales/presentation kit of FIG. 15 when the associated presentation box is in an opened position and when the contents have been removed.
Figure 19:
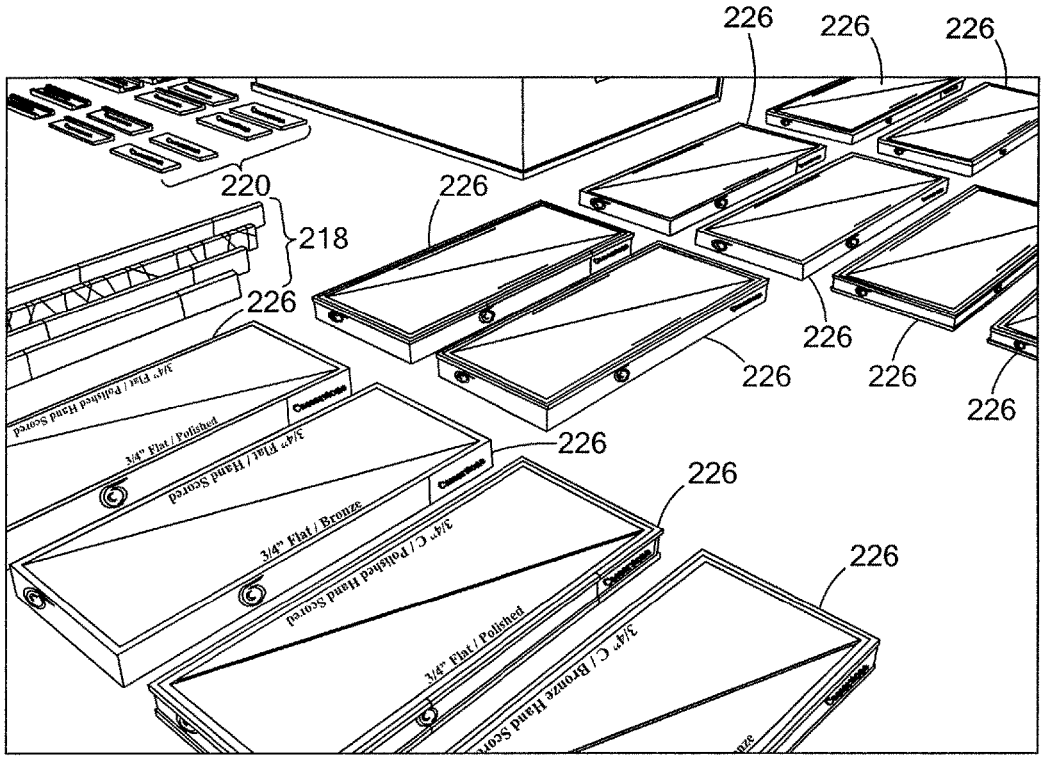
FIG. 19 shows an enlarged view of the sales/presentation kit of FIG. 18.

In order to illustrate the benefits of the edging of the present invention and in order to instruct others on how to install the edging previously described with respect to FIGS. 1-14, a presentation or sales kit 200 is stored in a presentation box 202 shown in FIG. 15. The presentation box 202 is rectangular in shape and has metallic top and bottom edges 204, 206, respectively. Of course, other shapes for presentation box 202 are possible without departing from the spirit of the invention. The presentation box 202 also may or may not have rectangular openings 207 formed in its side walls 210 in other to define handles for carrying the presentation box 202. As shown in FIGS. 16 and 17, the presentation box has a hinged top lid 212. When the lid 212 is opened, it reveals a top tray 214 that has slots to contain samples of straight metal pieces 216, handles 217, and corner metal pieces 218 with different profiles and finishes, tabs 220 having text etched thereon a manual 222 regarding the edging, and a USB flash drive 224. Note that the straight pieces 216, the handles 217, and the corner pieces 218 can also include text etched thereon. The tray 214 may also have slots to receive the previously described piping elements 142. The flash drive 224 can include application instructions, an instructional video of surface machining using the tool kit and installation of the metal pieces previously described with respect to FIGS. 1-14. The flash drive 224 can also provide application instructions, adhesive and finishing tips, and use and care instructions. When the top tray 214 is removed, it reveals various sample blocks 226 that have been machined to receive the straight sections 216. The sample blocks have various finishes to allow an observer to envision how a surface similar to a sample block will look when receiving one or more of the previously described straight metal pieces 216, handles 217, corner metal pieces 218 and tabs 220. The sample blocks 226 are positioned within corresponding vertical slots 228 defined by vertical walls/dividers located within the presentation box 202 and show various materials for the notched surface that is to receive the metal pieces 216 and 218.

It will be appreciated by those skilled in the art that changes could be made to the embodiments described above without departing from the broad inventive concept thereof.

I claim:

1. A surface, comprising:

a three-dimensional surface, wherein a rectangular-like notch is present in said three-dimensional surface, wherein said rectangular-like notch is defined by:

a first surface;

a second surface integral with said first surface and extending perpendicularly with respect to said first surface; and a third surface facing said first surface and integral with said second surface, wherein said first surface, said second surface and said third surface define a volume of space; and a rectangular-like metal edge inserted in its entirety into said volume of space defined by said rectangular-like notch and attached to said three-dimensional surface, wherein said rectangular-like metal edge comprises:

a first piece that extends lengthwise along a direction and comprises a male connector; and a second piece that comprises a female connector that interconnects with said male connector to form a male/female connection, wherein when said male connector engages said female connector, said second piece extends lengthwise along said direction; and said rectangular-like metal edge comprises:

a front surface that faces away from said second surface of said rectangular-like notch; and a rear surface that faces said second surface of said rectangular-like notch and covers in its entirety said second surface of said rectangular-like notch.

2. The surface of claim 1, wherein said three-dimensional surface is made of quartz.

3. The surface of claim 1, wherein said rectangular-like metal edge is made from the material selected from the group consisting of bronze, brushed stainless steel, and polished stainless steel.

4. The surface of claim 1, where indicia is etched onto said rectangular-like metal edge.

5. A method of manufacturing a surface, the method comprising:

forming a rectangular-like notch within a three-dimensional surface, wherein said rectangular-like notch is defined by:

a first surface;

a second surface integral with said first surface and extending perpendicularly with respect to said first surface; and a third surface facing said first surface and integral with said second surface, wherein said first surface, said second surface and said third surface define a volume of space; and inserting a rectangular-like first metal piece in its entirety within said volume of space defined by said rectangular-like notch, wherein said rectangular-like first metal piece extends lengthwise along a direction and comprises a male connector, said rectangular-like first metal piece comprises:

a front, planar surface that faces away from said second surface of said rectangular-like notch; and a rear surface that faces said second surface of said rectangular-like notch and covers in its entirety said second surface of said rectangular-like notch;

attaching said inserted rectangular-like first metal piece to said three-dimensional surface; and interconnecting said rectangular-like first metal piece with a second metal piece that comprises a female connector that interconnects with said male connector to form a male/female connection, wherein when said male connector engages said female connector said second metal piece extends lengthwise along said direction.

6. The method of claim 5, wherein said three-dimensional surface is made of quartz.

7. The method of claim 5, wherein said rectangular-like first metal piece is made from the material selected from the group consisting of bronze, brushed stainless steel, and polished stainless steel.

8. The method of claim 5, further comprising etching indicia onto said rectangular-like first metal piece.

9. The surface of claim 1, wherein said three-dimensional surface comprises:

a top horizontal surface positioned above said first surface of said rectangular-like notch;

a bottom horizontal surface positioned below said top horizontal surface and below said first surface of said rectangular-like notch; and a vertical side surface integral with said top horizontal surface and said bottom horizontal surface, wherein said rectangular-like notch is formed in said vertical side surface.

10. The surface of claim 1, wherein said male/female connection has a shape identical to an interconnection between two jigsaw pieces that engage one another.

11. The method of claim 5, wherein said three-dimensional surface comprises:

a horizontal top surface positioned above said first surface of said rectangular-like notch;

a horizontal bottom surface positioned below said horizontal top surface and below said first surface of said rectangular-like notch; and a vertical side surface integral with said horizontal top surface and said horizontal bottom surface, wherein said rectangular-like notch is formed in said vertical side surface.

12. The method of claim 5, wherein said male/female connection has a shape identical to an interconnection between two jigsaw pieces that engage one another.

13. A surface, comprising:

a three-dimensional surface comprising:

a horizontal top surface;

a horizontal bottom surface positioned below said horizontal top surface; and a vertical side surface integral with said horizontal top surface and said horizontal bottom surface, wherein a notch is formed in said vertical side surface and is positioned between said horizontal top surface and said horizontal bottom surface; and a metal edge inserted in its entirety into a volume of space defined by said notch and attached to said three-dimensional surface, wherein said metal edge comprises:

a first piece that extends lengthwise along a direction and comprises a male connector; and a second piece that comprises a female connector that interconnects with said male connector to form a male/female connection, wherein when said male connector engages said female connector said second piece extends lengthwise along said direction.

14. The surface of claim 13, where indicia is etched onto said metal edge.

15. The surface of claim 13, wherein said male/female connection has a shape identical to an interconnection between two jigsaw pieces that engage one another.

16. A method of manufacturing a surface, the method comprising:

forming a notch within a vertical side surface of a three-dimensional surface, wherein said three-dimensional surface comprises:

a horizontal top surface positioned above said notch;

a horizontal bottom surface positioned below said horizontal top surface and below said notch, wherein said vertical side surface is integral with said horizontal top surface and said horizontal bottom surface; and inserting a first metal piece in its entirety within a volume of space defined by said notch, wherein said first metal piece extends lengthwise along a direction and comprises a male connector;

attaching said inserted first metal piece to said three-dimensional surface; and interconnecting said first metal piece with a second metal piece, wherein said second metal piece comprises a female connector that interconnects with said male connector to form a male/female connection, wherein when said male connector engages said female connector said second metal piece extends lengthwise along said direction.

17. The method of claim 16, further comprising etching indicia onto said first metal piece.

18. The method of claim 16, wherein said male/female connection has a shape identical to an interconnection between two jigsaw pieces that engage one another.

19. A surface, comprising:

a three-dimensional surface, wherein a notch is formed in said three-dimensional surface and said notch has a length that is substantially greater than a depth and height of said notch; and a metal edge inserted in its entirety into a volume of space defined by said notch and attached to said three-dimensional surface, wherein said metal edge comprises:

a first piece that extends lengthwise along a direction and comprises a male connector; and a second piece that comprises a female connector that interconnects with said male connector to form a male/female connection, wherein when said male connector engages said female connector said second piece extends lengthwise along said direction.

20. The surface of claim 19, where indicia is etched onto said metal edge.

21. The surface of claim 19, wherein said male/female connection has a shape identical to an interconnection between two jigsaw pieces that engage one another.

22. A method of manufacturing a surface, the method comprising:

forming a notch within a three-dimensional surface, wherein said notch has a length that is substantially greater than a depth and height of said notch;

inserting a first metal piece in its entirety within a volume of space defined by said notch, wherein said first metal piece extends lengthwise along a direction and comprises a male connector;

attaching said inserted first metal piece to said three-dimensional surface; and interconnecting said first metal piece with a second metal piece, wherein said second metal piece comprises a female connector that interconnects with said male connector to form a male/female connection, wherein when said male connector engages said female connector said second metal piece extends lengthwise along said direction.

23. The method of claim 22, further comprising etching indicia onto said first metal piece.

24. The method of claim 22, wherein said male/female connection has a shape identical to an interconnection between two jigsaw pieces that engage one another.

* * * * *